United States Patent [19]

Davi

[11] Patent Number: 4,713,995

[45] Date of Patent: Dec. 22, 1987

[54] HOLE PUNCH ASSEMBLY

[75] Inventor: Richard A. Davi, Glenwood, N.J.

[73] Assignee: Rolodex Corp., Secaucus, N.J.

[21] Appl. No.: 783,677

[22] Filed: Oct. 3, 1985

[51] Int. Cl.[4] ..... B26F 1/02

[52] U.S. Cl. ..... 83/167; 83/468; 83/563; 83/588; 83/618; 83/633; 83/698

[58] Field of Search ..... 83/618, 633, 563, 588, 83/167, 467 R, 468, 522, 571, 698

[56] References Cited

U.S. PATENT DOCUMENTS

| | | | |
|---|---|---|---|
| 926,261 | 6/1909 | Krag | 83/618 |
| 2,328,558 | 9/1943 | Kipp | 83/618 |
| 3,073,199 | 1/1963 | Yerkes | 83/618 |
| 3,716,570 | 4/1965 | Gaya | 83/618 |
| 4,036,088 | 7/1977 | Ruskin | 83/588 |
| 4,288,018 | 9/1981 | Taniguchi | 83/618 |
| 4,449,436 | 5/1984 | Semerjian et al. | 83/698 |
| 4,466,322 | 8/1984 | Mori | 83/618 |

*Primary Examiner*—E. R. Kazenske
*Assistant Examiner*—Hien H. Phan
*Attorney, Agent, or Firm*—Martin Smolowitz

[57] ABSTRACT

A hole punch assembly for punching holes in papers and such, usually having dual spring-loaded punch units attached to a base member. The punch assembly is constructed from formed sheet steel and includes a rectangular-shaped base member having two spaced-apart rectangular shaped depressions and openings therein, each for receiving a spring-loaded punch unit rigidly attached to the base. The punch unit includes a frame folded to provide a gap through which a punch rod is extended through a hole, the frame enclosing a compression spring located around the punch rod and a spring-retaining shoulder ring is provided in a groove located between the frame and the upper end of the compression spring. The punch unit is rigidly attached to the base member so that the gap has its lower surface flush with the upper surface of the base member, to allow paper stacks or paper sheets for punching to be guided into the gap without any obstructions or hang-up. A handle is pivotally attached to dual uprights rigidly attached at the rearward sides of the base member. The base bottom side is enclosed by a resilient plastic tray member which acts as a non-marring pad for supporting the punch assembly on a table top surface and also retain paper chips until their periodic disposal by removal of the tray member.

6 Claims, 7 Drawing Figures

HOLE PUNCH ASSEMBLY

BACKGROUND OF INVENTION

The present invention pertains to a hole punch assembly for papers and such. It pertains particularly to a two hole punch assembly for which the dual punch units and a centering guide are each spring-loaded and attached to a formed base member which is supported in a resilient plastic tray member.

General arrangements and designs for two hole paper punches have been developed, such as are disclosed by various design patents. For example, U.S. Pat. No. Des. 144,601 to Yerkes utilizes a formed metal base unit and a pivoted handle having punch and springs incorporated into the handle. U.S. Pat. No. Des. 167,520 to Marano utilizes a hinge support formed by a curved flexible metal piece attached to the base and a formed handle pivotally attached to the base adjacent dual punches. U.S. Pat. No. Des. 183,155 to Aleks shows a punch of cast type construction and having punch and springs located in upright supports. U.S. Pat. Nos. Des. 193,230 and Des. 193,231 to Klein utilize a cast base member having integral supports for retaining the punches. Also, U.S. Pat. No. Des. 251,600 to MacGregor discloses a cast body construction. However, these designs usually involve either heavy cast metal constructions or formed sheet metal arrangements which are not as sturdy as desired. Consequently, a need exists for an improved design two hole spring-loaded punch assembly which is lightweight and sturdy in construction, and can be easily and inexpensively produced using a minimum of component parts.

SUMMARY OF INVENTION

The present invention provides a punch assembly for papers, etc., which is constructed essentially from formed metal elements, including a base plate member having at least two folded down sides and at least one depression and opening therein for receiving a separate spring-loaded punch unit containing a punch rod and a compression spring. A formed generally rectangular shaped handle is pivotally attached to folded down sides at the rear portion of the base member by dual upright supports, which are rigidly attached such as by rivets onto the base. The formed handle contains an elongated depressed rib located transversely near its rear side for contacting and depressing the spring-loaded punch rod of the punch unit. Two spaced-apart punch units are usually provided. A paper guide is provided slidably attached to the base member. The base folded down sides closely fit into a detachable resilient tray chip or pad molded of a plastic material, which tray encloses the lower side of the base member and acts as a non-marring pad for the punch assembly resting on a desk or table during use of the punch assembly.

The overall design and shape of the present hole punch utilizes formed sheet steel stampings for most of the individual parts, which are attached together by fasteners provided in punched holes in the parts. It is an important feature of the present paper punch design and construction that the punch units are each advantageously provided as separate folded metal spring-loaded units having a gap and which are rigidly attached into dual recesses formed in the base member or unit, such as by a riveted construction. The dual supports for the handle are attached to the inside of the folded down sides of the base member. Each punch unit is provided with an integral punch rod aligned with a hole and surrounded by a compression spring. Each punch unit is advantageously fastened into the base member recess flush with the top surface of the base member, so as to permit easy entry of papers in which holes are to be punched, instead of being integrally cast into the support structure of the assembly as usually used in prior art punches.

The present invention advantageously provides a punch assembly which is lightweight, simple and sturdy in its construction, and which can be readily and inexpensively asembled from formed steel parts, and includes a resilient molded plastic tray member for supporting the punch assembly. Although the punch assembly is described as preferably for a two-hole punch design, the basic construction configuration can also be used for one hole or three hole punch assemblies.

DESCRIPTION OF INVENTION

Figure 1:
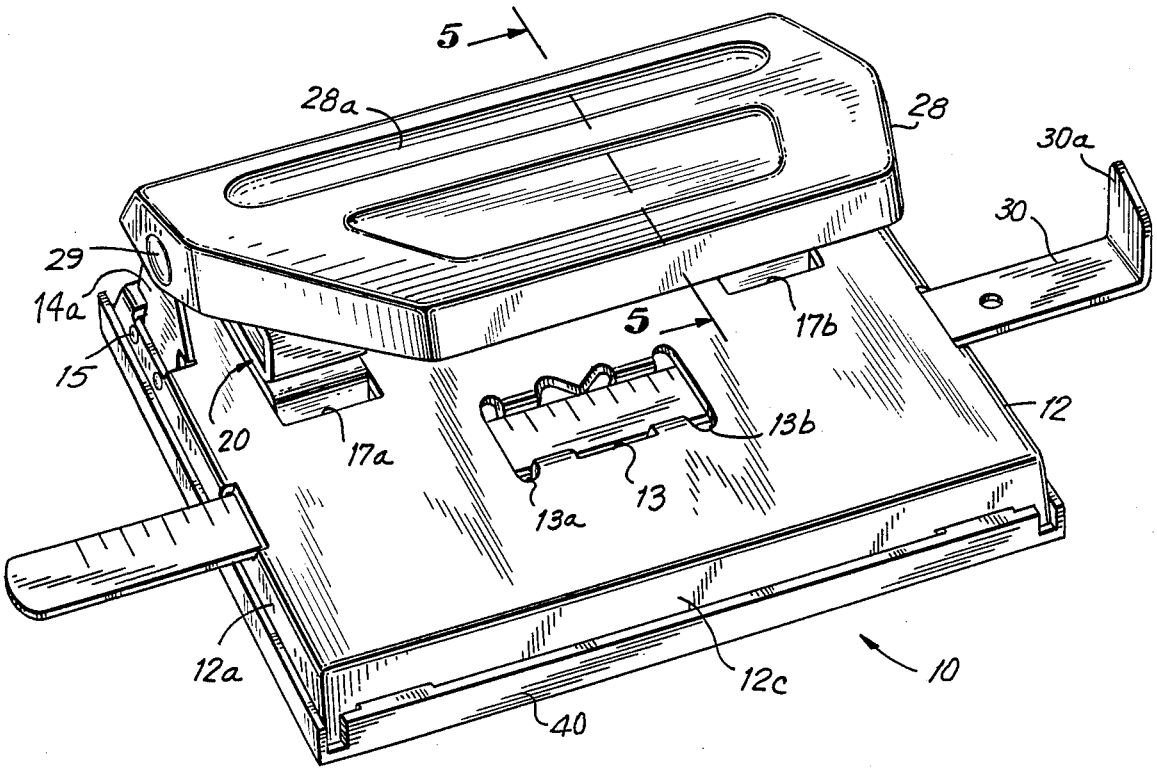
FIG. 1 shows a perspective view of a two hole punch assembly according to the invention.
Figure 2:
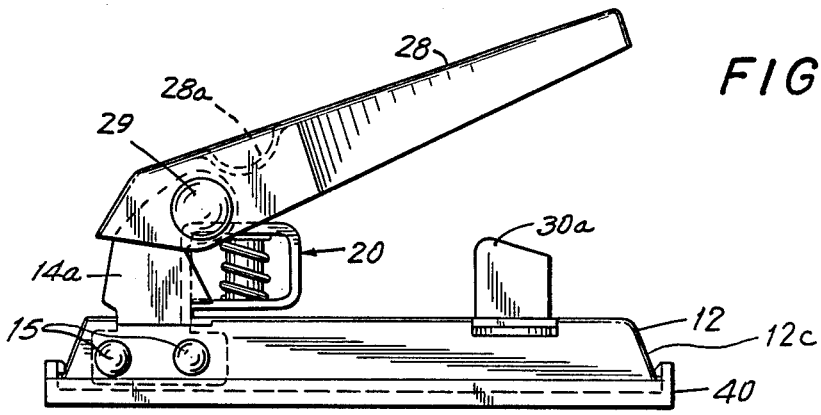
FIG. 2 shows a side elevation view of the punch assembly.
Figure 3:
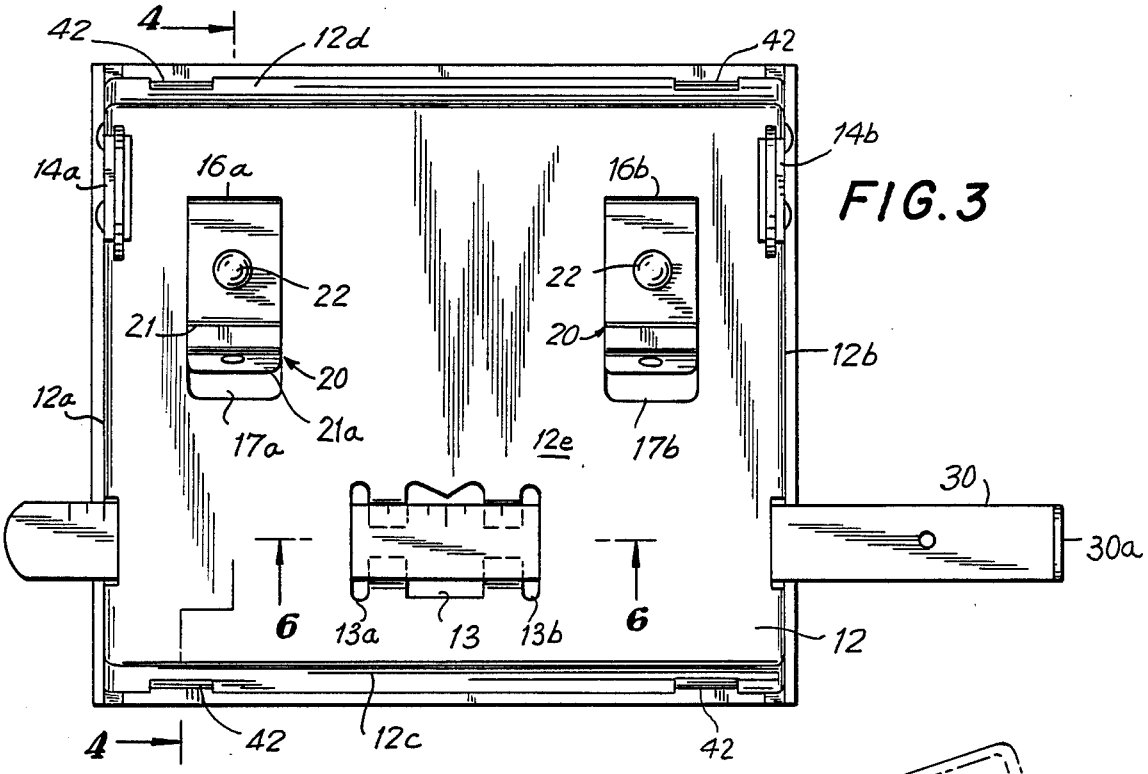
FIG. 3 shows a plan view of the base member of the punch assembly, with the handle removed.
Figure 4:
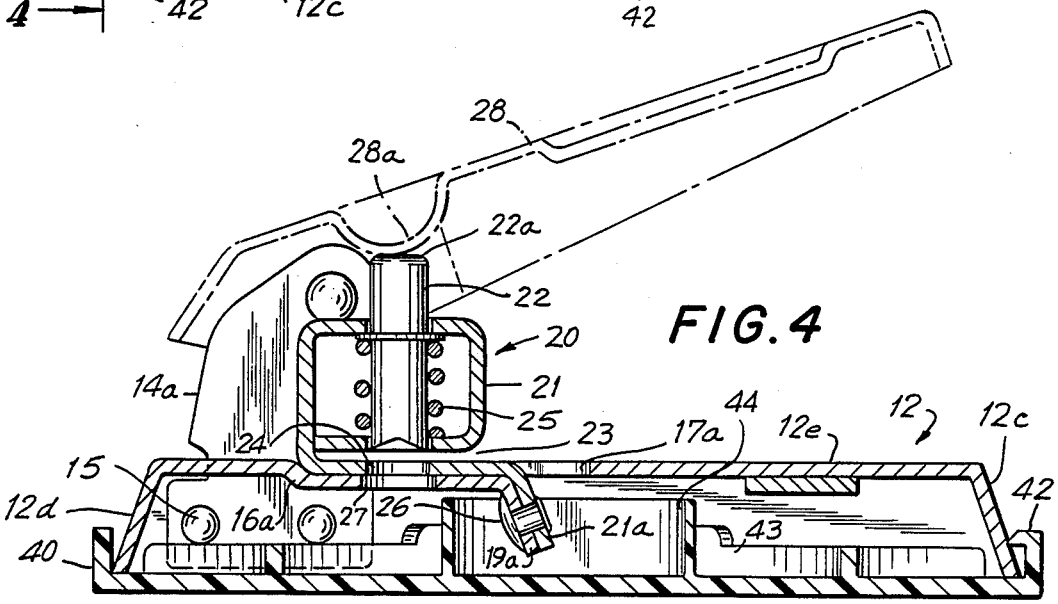
FIG. 4 shows a partial sectional side elevation view of the punch assembly taken at lines 4—4' of FIG. 3, showing attachment of the spring-loaded punch unit to the base member.
Figure 5:
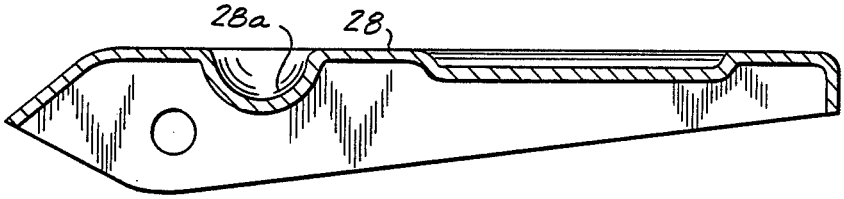
FIG. 5 shows a partial sectional view of the handle taken at section 5—5' of FIG. 1.
Figure 6:
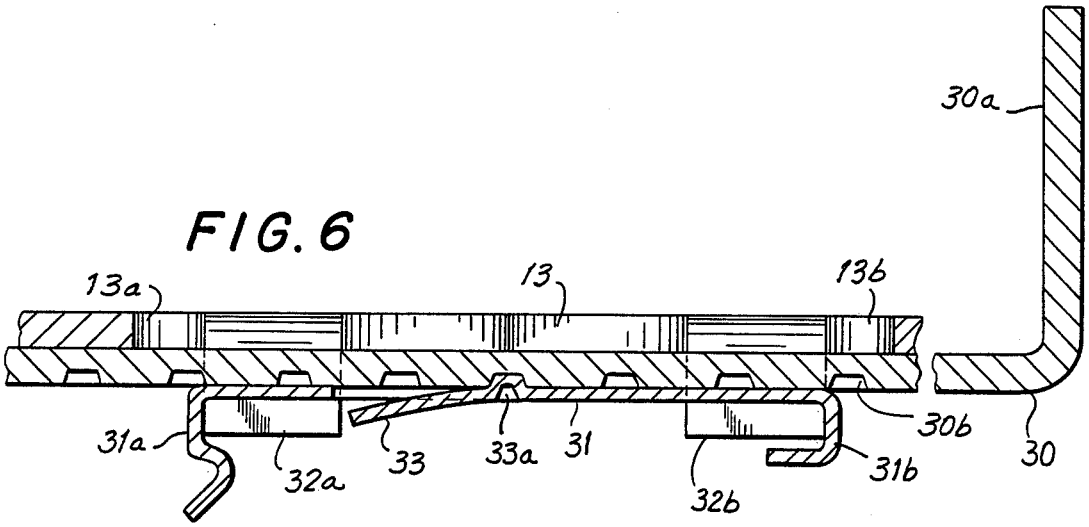
FIG. 6 is a partial sectional view taken at lines 6—6' of FIG. 3, showing attachment of the paper guide to the base member.

The hole punch assembly will now be described in greater detail with reference to the above drawings, which show a preferred two hole punch configuration. As shown in FIGS. 1–4, the punch assembly 10 includes a base member 12 which is formed of sheet steel to have four downwardly flanged edges or sides **12*a*, 12*b*, 12*c*, and 12*d*. Dual upright supports 14*a* and 14*b* are rigidly attached to the inner vertical opposite sides 12*a* and 12*b* of the base member 12 by dual rivets 15, as is better shown in FIGS. 2 and 4**.

in the rear portion of base member 12 are provided dual rectangular depressions **16*a* and 16*b* and adjacent openings 17*a* and 17*b*, as shown in FIG. 3. A spring-loaded punch unit 20 is fitted into each of the depressions 16*a* and 16*b*, as is best shown in sectional elevation drawing FIG. 4. The punch unit 20 includes frame 21, which is folded so as to provide a gap 23 through which a cylindrical shaped punch 22 is extended to hole 24 in the frame and encloses a compression spring 25 located around the punch 22 along with a spring retaining shoulder ring 22*a* provided in a circular groove located between frame 21 and the upper end of compression spring 25. The lower end of the punch rod 22 has dual inwardly beveled surfaces 22*c* so as to provide dual cutting edges. For each punch unit 20, frame 21 has a lower extension portion 21*a* which is rigidly attached to extension portions 19*a* and 19*b* of base member 12, such as by rivet 26, so that the gap 23 lower surface is made flush with the upper surface 12*e* of base member 12. As shown in FIG. 4, the punch hole 24 of punch unit 20 is aligned with hole 27 centrally provided in depression 16***a* and 16*b* in base member 12.

A handle member 28 is pivotally attached to the upper ends of the upright supports 14*a* and 14*b* by pivot pin 29. The handle 28 is provided with a depression 28*a* formed in its rearward portion, which depression is located so as to be in alignment with the upper ends 22*a* of dual punches 22. By this configuration, when the pivoted handle 28 is pressed downwardly the depressed surface 28*a* contacts the upper end 22*a* of the dual punches 22 and forces the spring-loaded punches 22 downwardly through holes 24 so as to punch holes in a sheet or stack of sheets of paper placed in gap 23, whenever the handle is forced downwardly about pivot point 29. The handle 28 should have the depression 28*a* located relative to the pivot points 29 so as to provide an adequate mechanical advantage of about 4 to 8, to permit punching multiple sheets of paper without requiring an excessive downward force on the handle 28. The paper chips produced are pushed through holes 24 and 27 into a reservoir space provided between the bottom surface of base member 12 and a tray member 40, and retained in the tray for periodic disposal.

The base member 12 is advantageously provided with a paper guide 30, which is slidably attached transversely to base 12 below the central portion 12*e*. Guide 30 has a turned up end 30*a* and is provided with suitable dimensional markings on its upper surface to facilitate centering and positioning the paper sheets being punched. To retain guide 30 in a selected position relative to the punches 22, a folded flat spring 31 is provided below base 12, which flat spring is retained by dual loops 32*a* and 32*b* which are pressed downwardly from base member 12 by central opening 13 together with associated end openings, 13*a* and 13*b*, as shown in FIG. 3. The plate spring 31 has folded over ends 31*a* and 31*b* and a resilient tongue portion 33 and a centrally located dimple 33*a* which contacts notches 30*b* located on the lower side of the paper guide 30, to aid in retaining the guide in a selected position relative to the base member 12 and the dual punches 22.

Figure 7:
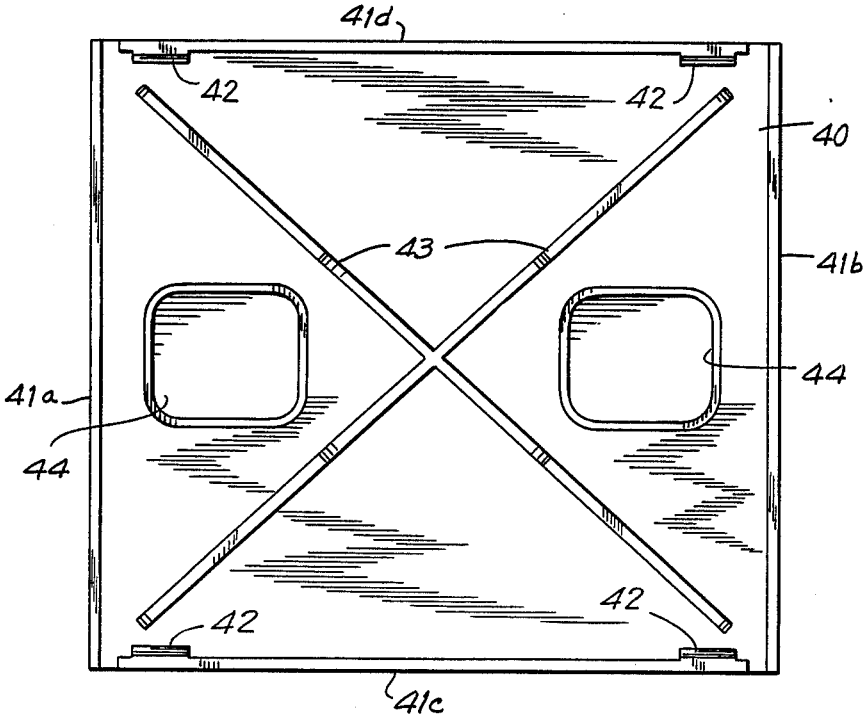
FIG. 7 shows a top plan view of the tray member with the base member removed.

The lower side of base member 12 is enclosed by a resilient tray member 40, which is shown in plan view by FIG. 7, to catch paper chips for future disposal. This tray member 40 is made of a stable but resilient plastic material, such as polypropylene, and has upwardly flanged sides 41*a*, 41*b*, 41*c* and 41*d* on its four sides, which are sized to grip the outer flanged edges of base member 12 and be retained in position against the base 12. The upwardly flanged sides 41*c* and 41*d* each contain projections 42 which retain tray member 40 against the angled front flanged edge 12*c* and rear flanged edge 12*d* and provide for retaining the tray firmly against bare member 12 during normal use of the punch assembly. The tray material should be sufficiently rigid and yet sufficiently resilient to permit removal of the tray member 40 for periodic disposal of the paper chips accumulated therein. during normal use of punch assembly. To assist in providing sufficient rigidity for tray member 40, a generally cross-shaped integral upward projection 43 is provided as reinforcement, together with dual generally rectangular-shaped upward projections 44. The projections 44 are located so as to surround the openings 17*a* and 17*b* and the downwardly extending attachments of extension 21*a* of the punch units 20 to the base member extension 19*a*, and thereby prevent escape of paper chips through rear flanged edge 12*d* of base member 12. The tray member 40 is preferably made symmetrical so that it can be conveniently installed onto base member 12 and serve as a nonmarring pad for resting on a desk or table top surface during use of the punch assembly.

The punch assembly according to this invention will be further described by the following example of construction, which should not be considered as limiting in scope.

EXAMPLE

A two hole paper punch was produced having a base member and handle each formed of sheet steel 0.048 inch thick. The handle was pivotally attached to the base member by dual upright supports each about 0.060 inch thick riveted to the downwardly flanged sides of the base member. The punch holder units were each formed of steel 0.075 inch thick and folded to retain a punch rod of hardened steel having lower ends beveled inwardly, each punch being 0.250 inch diameter and operated in holes of 0.255 inch diameter. The handle had a mechanical advantage of 7.7/1, so that a force of about 10 pounds was required to compress the dual springs and move the punches through the respective holes and cut sheets of paper placed in the gap of the punch unit.

Although the punch assembly according to the present invention has been described broadly and in terms of a preferred embodiment, it will be understood that modifications and variations can be made and that some features can be employed without others, all within the scope of the invention, which is defined by the following claims.

I claim:

1. A hole punch assembly for punching holes in sheet materials, comprising:

(a) a base member having an upper surface and at least two downardly folded sides located on opposite sides of the base member and at least one centrally located downward depression and opening provided therein;

(b) at least one spring-loaded punch unit fixedly attached to said base member within said depression and opening in said base member to a bownward extension portion of the depression, said punch unit including a frame folded so as to provide a gap therein adjacent the base member, a punch rod and a compression spring located around the punch rod, and a spring-retaining shoulder ring rigidly attached to the punch rod between the frame and the compression spring upper end, the lower surface of said gap being located flush with the upper surface of the base member;

(c) dual upright supports rigidly attached to the downwardly folded opposite sides of said base member, each said upright support extending upwardly through an opening provided adjacent to two opposite sides of the base member;

(d) a formed handle pivotally attached to the upper ends of said dual upright supports, said handle having at least one downwardly depressed rib disposed so as to contact the upper end of the punch rod in said punch unit whenever the handle is pressed downwardly; and (e) a tray member enclosing the lower side of said base member for retaining punched out material chips therein, said tray member being provided with four upwardly flanged sides which enclose the base member downwardly folded sides by projections on the upwardly flanged sides of the tray member, with at least two of said flanged sides, each of which being provided with at least two projections; and being removable from the base member for periodic disposal of the accumulated chips.

2. A hole punch assembly according to claim 1, wherein two said spring-loaded punch units are provided spaced apart from each other, each said punch unit being rigidly attached to said extension portion of the base member depression by rivets.

3. A two hole punch assembly according to claim 2, including a guide slidably attached transversely to said base member at a location below a central opening provided in the upper surface of the base member for positioning the sheet materials being punched.

4. A two hole punch assembly according to claim 3, wherein said slidable guide is attached below the upper surface of said base member by dual loops which are pressed downwardly from the base member, and a folded flat spring is retained by said dual loops and has a resilient tongue portion which contacts the lower side of the guide.

5. A two hole punch assembly according to claim 2, wherein the upper surface of said tray member contains an integral upward projection and dual rectangular-shaped upward projections each located in alignment with the openings in said base member for structural reinforcement of the base member and for retaining punched chips.

6. A two hole punch assembly for punching holes in sheet materials, comprising:

(a) a rectangular shaped formed metal base member having four downwardly folded sides and dual centrally located downward depressions and openings spaced apart from each other in said base member;

(b) dual spring-loaded punch units, said punch units being spaced apart from each other and each fixedly attached within each said depression and opening in said base member to a downward extension portion of the depression, each punch unit including a frame folded so as to provide a gap therein located adjacent the base member, a punch rod aligned with holes in the frame, and a compression spring located around the punch rod, and a spring-retaining shoulder ring rigidly attached to the punch rod between the frame and the compression spring upper end, each said punch unit being located so that the lower surface of said gap is flush with the upper surface of the base member;

(c) dual upright supports each rigidly attached by dual rivets to the inner surface of the downwardly folded opposite sides of said base member near its rear side, each said upright support extending upwardly through an opening in the base member adjacent the two opposite sides of said base member;

(d) a formed handle pivotally attached to the upper ends of said dual upright supports, said handle having an elongated downardly depressed rib located transversely therein for contacting the upper end of said punch rod in each said punch unit whenever the handle is pressed downwardly;

(e) a paper guide slidably attached transversely to the lower side of said base member by dual loops which are each pressed downwardly from said base member, and a flat spring retained by said dual loops and which resiliently contacts the lower surface of the guide; and (f) a resilient molded plastic tray member for retaining punched out chips therein enclosing the lower side of said base member, said tray member having four upwardly flanged sides which enclose and are retained to the base member downwardly folded sides by projections provided on the upwardly flanged sides of the tray member with at least two of said flanged sides each of which being provided with at least two projections, and being removable from the base member for periodic disposal of the accumulated chips.

* * * * *